United States Patent [19]

Pancer

[11] 3,994,308

[45] Nov. 30, 1976

[54] CIGARETTE EXTINGUISHER

[76] Inventor: Alex Pancer, No. 110 Elise Terrace, Willowdale, Ontario, Canada

[22] Filed: May 16, 1975

[21] Appl. No.: 578,014

[52] U.S. Cl. ..... 131/256

[51] Int. Cl.[2] ..... A24F 19/14

[58] Field of Search ..... 131/235 R, 237, 240 E, 131/256; 206/19.5; 220/18

[56] References Cited

UNITED STATES PATENTS

| | | | |
|---|---|---|---|
| 2,722,939 | 11/1955 | Smillie | 131/256 |
| 2,778,365 | 1/1957 | Silverman et al. | 131/235 R |
| 2,964,044 | 12/1960 | Bryan | 131/256 |
| 3,173,641 | 3/1965 | Dorrance | 131/256 X |
| 3,411,516 | 11/1968 | McWilliams | 131/235 R |

FOREIGN PATENTS OR APPLICATIONS

| | | | |
|---|---|---|---|
| 261,275 | 4/1968 | Austria | 131/235 R |
| 759,492 | 11/1933 | France | 131/235 R |

*Primary Examiner*—Robert W. Michell
*Assistant Examiner*—V. Millin
*Attorney, Agent, or Firm*—George H. Riches & Associates

[57] ABSTRACT

This invention relates to a cigarette extinguisher having a body with a cylindrical cigarette receiving well therein, and a body holder. The body holder may be adhesively secured in a desired position to a vertical or horizontal surface, for instance to the dash of an automobile above an open ashtray. The body is pivotally removably received in the body holder with the cylindrical well in an upright position in which a lit cigarette may be conveniently dropped into it to extinguish the cigarette virtually instantaneously through the lack of oxygen. The body may be pivoted in the body holder to a downwardly directed position wherein the extinguished cigarette drops from the body into the open ashtray. Alternatively, the body may be removed from the body holder and the extinguished cigarette otherwise conveniently disposed of. The cigarette extinguisher may be readily secured to the dash of an automobile to reduce the well known difficulties of extinguishing cigarettes while driving.

4 Claims, 5 Drawing Figures

CIGARETTE EXTINGUISHER

This invention relates to a cigarette extinguisher and more particularly to a cigarette extinguisher having a vertical well adapted to be mounted on an automobile dash.

In the past, it has been well know to provide conventional ashtrays designed to be rested on a horizontal surface or object with a number of vertical wells for extinguishing the cigarettes. While these ashtrays are suitable for normal use, it is not possible to secure them to a surface in a desired location such as to a vertical surface of an automobile dash. Furthermore, these previously known ashtrays have necessarily been formed of sufficient size to provide a receptacle to receive a number of extinguished cigarettes which adds to the difficulty of conveniently mounting them.

Accordingly, it is an object of the present invention to at least partially overcome these disadvantages by providing a cigarette extinguisher which may be secured in a desired position on a surface such as the surface of an automobile dash and from which the cigarette may be readily disposed so as not to require a receptacle for the receipt of a number of extinguished cigarettes.

To this end in one of its aspects the invention provides a cigarette extinguisher comprising a body having a cylindrical well with a circular mouth adapted to retainably receive a lighted cigarette, the body having securing means to secure it to a surface in a position with the well opening vertically upward.

In another of its aspects, the invention further provides a cigarette extinguisher having a body and a body holder, the body holder adapted to be fixedly secured to a fixed surface, the body being removably pivotally attached to the body holder, the body having a cylindrical well with a circular mouth adapted to retainably receive a lighted cigarette, the body being pivotable between a first position parallel to said surface, a second position perpendicular to said surface and a third position in which the well opens downward to dispose of the cigarette.

Known automobile ashtrays have the well known disadvantage that it is very difficult for the driver to completely extinguish a cigarette in them without being distracted. Furthermore, in doing so, other objects disposed of in the ashtray often are ignited, necessitating stopping of the vehicle.

Further objects and advantages of the invention will appear from the following description taken together with the accompanying drawings in which.

Figure 1:
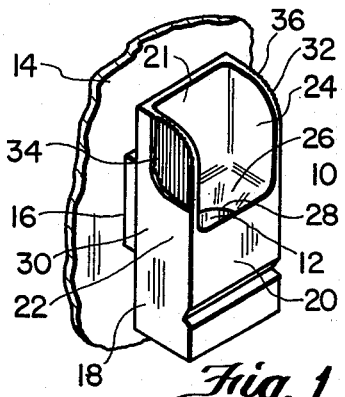
FIG. 1 is a perspective view of a cigarette extinguisher according to a first embodiment of the invention secured to a vertical surface.
Figure 2:
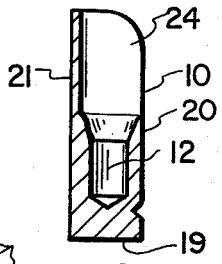
FIG. 2 is a cross sectional view of FIG. 1.

Reference is first made to FIG. 1 which shows a cigarette extinguisher having a body 10 with an upwardly opening cylindrical well 12 attached to a metallic vertical surface 14 by a magnet 16. The extinguisher body 10 has a lower body portion 18 with a bottom surface 19 and a front surface 20. The lower body portion 18 defines cylindrical well 12 and has a rear wall 21 and a pair of side walls 22, 24 extending upward therefrom. The rear wall 21 and the side walls 22, 24 define a box-like opening at the upper front of the extinguisher body 10, and surface 26 slopes downwardly inward therefrom to define the circular mouth 28 of the well 12. As may be seen, the body 10 has side surfaces 30, 32 with roughened upper portions 34, 36 to facilitate gripping the body. The body 10 is formed of aluminum or steel or other suitable heat resistant material. A magnet 16 is fixed to the rear surface of rear wall 21 by adhesive or other suitable means and therefore the extinguisher body 10 may be repositioned in any desired location on vertical surface 14. The cylindrical well 12 is slightly larger in diameter than a cigarette and has sufficient depth (as may be seen in FIG. 2) to retain a cigarette dropped into it.

In use, the cigarette extinguisher body 10 is located on a vertical surface in a desired position with the cylindrical well 12 extending vertically upward. When it is desired to extinguish a cigarette, the lit end of the cigarette is inserted into the box-like opening defined by the rear wall 21 and the side walls 22, 24 where contact with tapered surface 26 guides the lit end of the cigarette to the mouth 28 of the cylindrical well 12. The cigarette is then merely dropped into the well 12 without any downward force being applied to it and the lack of oxygen in the confined area extinguishes the cigarette virtually instantaneously. The extinguisher body 10 may then or later be detached from the vertical surface 14 to dispose of the extinguished cigarette in a convenient depository.

Figure 3:
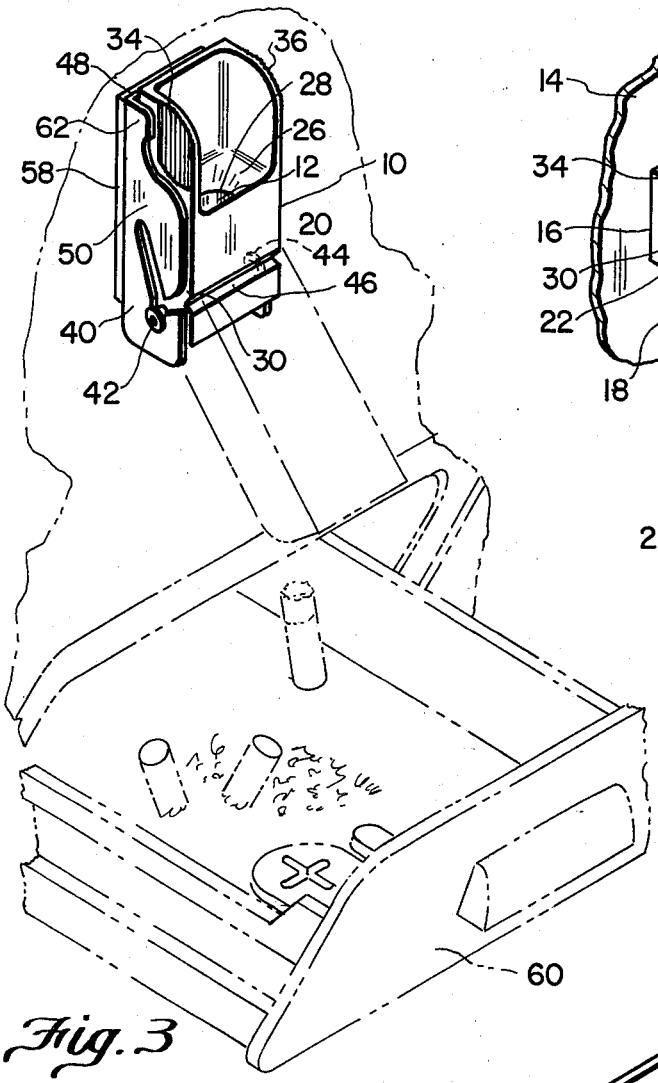
FIG. 3 is a perspective view of a cigarette extinguisher according to a second embodiment of the invention secured to the surface of an automobile dash above a conventional automobile ashtray which is in the open position.
Figure 4:
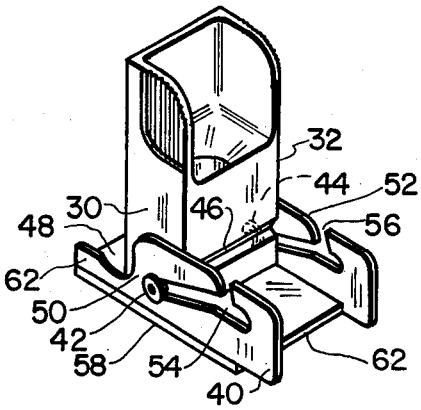
FIG. 4 is a perspective view of the embodiment of the invention seen in FIG. 3 secured to a horizontal surface.
Figure 5:
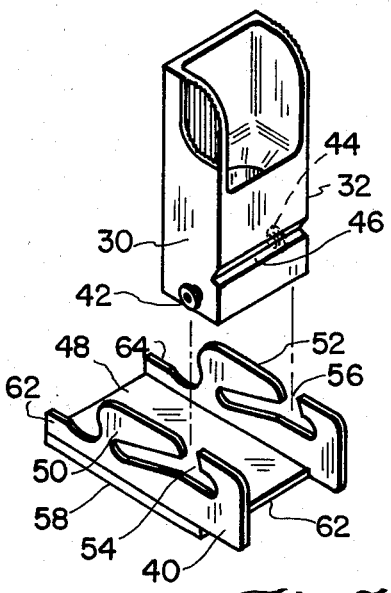
FIG. 5 is an exploded view of the embodiment of the invention seen in FIG. 4 showing the body removed from the body holder.

Referring to the second embodiment of the cigarette extinguisher seen in FIGS. 3 to 5, as many of the features are identical to those of the first embodiment, features common to both embodiments are described and illustrated using the same reference numerals. In this second embodiment the cigarette extinguisher has a body 10 and a body holder 40. The body 10 of the second embodiment is indentical to that of the first embodiment except that it has a pair of pins 42, 44 with enlarged heads extending from the side surfaces 30, 32 near the bottom surface 19 and a V-shaped groove 46 extending horizontally across front surface 20. The body holder 40 may also be formed of aluminum as steel or other material with suitable structural strength and has a rear wall 48 from which extend a pair of identical side flanges 50, 52. The side flanges 50, 52 are spaced apart to receive the body 10 therebetween. The side flanges 50, 52 each have a shaped slot 54, 56 extending therethrough to respectively engagingly receive the pins 42, 44 of the body 10 when the body is received in the body holder 40. The body holder 40 has a strip of adhesive 58 with a removable covering fixed to its rear wall 48.

In use, the removable covering is stripped from the adhesive and the body holder 40 secured to either a vertical wall (as seen in FIG. 3) or a horizontal surface (as seen in FIG. 4). Referring first to FIG. 3, the body holder 40 may conveniently be secured to the vertical surface of an automobile dash directly above a conventional automobile ashtray 60. The extinguisher body 10 is then placed in the holder by inserting the pins 42, 44 into the slots 54, 56 and pivoting the body to the upright position shown. The body 10 is retained in this position by fricitional contact between the side flanges 50, 52 of the body holder 40 and the side walls 22, 24 of the body 10. As may be seen, the side flanges 50, 52 have upper ears 62, 64 which may be bent slightly inward to improve this frictional contact with the side walls 22, 24 of the body 10. As described above in regard to the first embodiment, a lit cigarette may be dropped into the cylindrical well 12 to extinguish it virtually immediately. The extinguisher body 10 may then be grapsed by the roughened portions 34, 36 and pivoted forward to release it from frictional engagement with the body holder 40. The body 10 will then pivot downwardly as seen in FIG. 3, and the extinguished cigarette will drop into the open ashtray 60. The body may then be pivoted back to the upright position ready for future use. Alternatively, the body 10 may be readily completely removed from the body holder 40 by disengaging pins 42, 44 from slots 54, 56 to otherwise dispose of the extinguished cigarette or to clean the body 10.

Referring to FIGS. 4 and 5 showing the second embodiment of the invention with the body holder 40 adhesively secured to a horizontal surface, the extinguisher body 10 may be placed in the body holder 40 with the pins 42, 44 received in the position shown in the slots 54, 56 wherein the bottom surface 19 of the body 10 abuts on the rear wall 48 of the body holder 40 to retain the body 10 in the vertically upright position. As will be readily appreciated, in this position a lit cigarette may conveniently be dropped into the vertical cylindrical well 12 of the body to extinguish it. The extinguished cigarette may then be conveniently disposed of by lifting the body 10 from the body holder 40 as seen in FIG. 5. Alternatively, if the body holder 40 is located above an ashtray (not shown) the body 10 may be slid from the position shown in FIG. 4 to a position with the pins 42, 44 in the opposite ends of the slots 54, 56, and then pivoted forwardly downwardly to a position wherein leading edge 62 of the rear wall 48 of the body holder 40 is received in V-shaped groove 46 and the extinguished cigarette drops from the body 10 into the open ashtray.

Although the disclosure describes and illustrates preferred embodiments of the cigarette extinguisher, it is to be understood that the invention is not restricted to these particular embodiments. In particular, it is apparent that the body 10 could equally as well be provided with more than one cylindrical well 12.

The embodiments of the invention in which an exclusive property or privilege is claimed are defined as follows:

1. A cigarette extinguisher comprising a body having a cylindrical well with a circular mouth adapted to retainably receive a lighted cigarette and a body holder adapted to be fixedly secured to a surface, the body being removably received in the body holder with the well opening vertically upward, body holder having a rear wall with a pair of side flanges extending therefrom to receive the body therebetween, each of the side flanges having a slot therethrough, the body having a pair of side surfaces each having a pin projecting therefrom to be engagingly received in said slot in the respective side flange of the body holder.

2. A cigarette extinguisher as claimed in claim 1 wherein the body has a flat bottom surface and the pins are located on the body side surfaces adjacent the bottom surface and are slidably received in the slots whereby the body holder may be secured to a horizontal surface and the body movably retained in a cigarette receiving position with the well mouth opening upward by the flat bottom surface of the body being in bearing contact with the rear wall of the body holder.

3. A cigarette extinguisher as claimed in claim 1 wherein the holder may be secured to a vertical surface and the body movably retained in a cigarette receiving position with the well mouth opening upward by frictional contact between the side flanges of the body holder and the side surfaces of the body.

4. A cigarette extinguisher as claimed in claim 1 wherein a strip of adhesive having a removable covering is fixed to the rear wall of the body holder to adhesively secure the body holder to a desired surface.

* * * * *